United States Patent [19]

Lonati

[11] 4,201,067

[45] May 6, 1980

[54] SAFETY DEVICE IN A CIRCULAR KNITTING MACHINE

[75] Inventor: Francesco Lonati, Brescia, Italy

[73] Assignee: Costruzioni Meccaniche Lonati S.p.A., Brescia, Italy

[21] Appl. No.: 899,661

[22] Filed: Apr. 24, 1978

[30] Foreign Application Priority Data

Apr. 28, 1977 [IT] Italy ..... 22937 A/77

[51] Int. Cl.[2] ..... D04B 15/32; D04B 15/66

[52] U.S. Cl. ..... 66/222; 66/57

[58] Field of Search ..... 66/50 R, 8, 57, 123, 66/222, 223, 224, 226, 227

[56] References Cited

U.S. PATENT DOCUMENTS

| | | | |
|---|---|---|---|
| 1,105,735 | 8/1914 | Wildman et al. | 66/57 X |
| 3,442,097 | 5/1969 | Lonati | 66/50 R |
| 3,662,572 | 5/1972 | Lonati | 66/50 R |

FOREIGN PATENT DOCUMENTS

| | | | |
|---|---|---|---|
| 342972 | 7/1972 | U.S.S.R. | 66/8 |

*Primary Examiner*—Wm. Carter Reynolds

*Attorney, Agent, or Firm*—Guido Modiano; Albert Josif

[57] ABSTRACT

A circular knitting machine having tiltable pattern jacks, intermediate jacks thereon and needles over the intermediate jacks, the pattern jacks having lower butts for being raised and lowered by substantially triangular cams rigid with a cam ring. The lowering portion of the cams has a curvilinear portion joining the lowering portion and having a radius of curvature which is smaller than the ideal radius of connection between the lowering portion and the horizontal portion of the cam ring between the cams. The curvilinear portion remains at a distance from a base plane of the cam ring substantially corresponding to the distance between the lower face of the lower butt of the pattern jacks and the lower face of the pattern jacks. The curvilinear portion is followed by a further descending portion. There is therefore provided a cam lowering portion having a rounded step which causes the pattern jacks to approach progressively to the base plane, thus avoiding a kick back of the pattern jacks which in known machines operating at high speed causes breakage of the butts of the intermediate jacks.

5 Claims, 4 Drawing Figures

SAFETY DEVICE IN A CIRCULAR KNITTING MACHINE

BACKGROUND OF THE INVENTION

This invention relates to a safety device in a circular knitting machine, in particular a high speed single cylinder stocking knitting machine. More specifically, the invention relates to a safety, or protection, device adapted to prevent breakage of the butts of knitting instruments, particularly the butts of the intermediate jacks in a single cylinder stocking knitting machine.

It has been found that as the rotational speed of a single cylinder circular stocking knitting machine increases, a behavior is evidenced with increasing frequency which does not occur at normal operating speeds, namely the breakage of the butts of the intermediate jacks, which are located, as is well known in the art, between the needles and respective pattern jacks thereunder.

It has also been found that the occurrence of such breakage is more frequent, the higher is the speed at which a given machine is caused to rotate.

This behavior, which is not easily explained, represents a considerable difficulty encountered in designing and building high speed machines, in accordance with a modern trend.

Attempts have been made to obviate this problem by providing intermediate jacks of a special type, i.e. of a tougher material. During tests carried out with intermediate jacks made of such a material, an actual reduction in the number of butt breakages has been observed, although the problem failed to be eliminated altogether. On the contrary, it became evident that, while at a given high speed the number of breakages of the special type butts was statistically lower than in the case of butts made of the usual material, still the problem tends to reappear substantially as before at higher speeds.

On the other hand, it will be appreciated that when even a single butt of an intermediate jack breaks, it is no longer possible to carry on knitting, and the machine must be stopped, the product discarded, and the broken intermediate jack must be replaced, with an obvious loss of output.

As regards the breakage itself, this invariably occurs for a certain length along a direction parallel to that of the butt at the area of the intermediate jack where the stem of the intermediate jack joins the butt portion. This condition was also investigated, but no satisfactory cure had been found heretofore to prevent breakage in high speed machines, i.e. speeds in excess of 400 RPM.

SUMMARY OF THE INVENTION

It is a primary object of this invention to obviate such drawbacks.

It is thus the technical task whereon this invention is based to provide a safety device for use in a circular knitting machine, in particular a high speed single cylinder stocking knitting machine, which device is effective to prevent breakage, in particular to the intermediate jack butts, even at speeds above 400 RPM.

Within the frame of this technical task, it is another object of the invention to provide such a device which is also effective when the intermediate jacks, or other members cooperating in the formation of the knitting stitch and provided with a butt portion, are not made of a special material.

A further object of the this invention is to provide such a device, which is of simple and inexpensive construction.

This task is accomplished, and these objects are achieved, according to this invention, by a safety device in a circular knitting machine, in particular a high speed single cylinder stocking knitting machine, including tiltable pattern jacks and a jack guiding ring having at least one substantially triangular cam for lifting and lowering said jacks at a yarn feed, said cam being engageable by the lower butts of said jacks, and at least one horizontally extending portion downstream of said cam adapted to permit said jacks to tilt in and out, as well as a continuous base surface inside said ring for engaging the lower face of those jacks which are not being engaged by said cam, the device being characterized in that at the end of the downward sloping portion of said cam a curvilinear portion is provided joining said downward sloping portion and having a smaller radius of curvature than the ideal radius of connection of said downward sloping portion to said horizontally extending portion, said curvilinear portion tending to reach, with respect to said base surface, a level substantially corresponding to the level of the lower face of said lower jack butts with respect to the lower face of said jacks, and being connected to said horizontally extending portion by means of a further downward sloping portion.

In fact, it has been surprisingly discovered that with such a configuration of the cam, breakage of the intermediate jack butts is effectively prevented at high rotational speeds. The explanation of the above is to be found in that, in the instant invention, the pattern jack, which moves rapidly down along the downward sloping portion of the cam under the urge by the associated needle, is progressively moved towards the horizontally extending portion, while being caused to follow the cam profile, without striking with its lower or base face sharply the base surface within the ring whereon the cam is formed, as is the case instead with prior art machines.

It has been found, in fact, that the prime cause of breakage of the intermediate jack butts is indeed such a sharp impact of the lower or base face of the pattern jack against the inner base surface of the ring, said impact being due to the fact that the horizontally extending portion, which slopes transversely down towards the outer portion of the guide ring, as do the cam and the lower face of the jack butts, must of necessity locate itself at all points, with respect to the base surface, at a level which is smaller than the distance between the butt lowermost portion and the lower face of the jack, such as to permit the jack to tilt radially for the selection function, thereby, in the prior art machines such a horizontally extending portion being uniformly connected to the downward sloping portion of the cam, at a certain point of the downward slope the jack hits the base surface, whilst the butt disengages from the connective portion. The vertical component of the jack descending movement is then suddenly cancelled, which involves, at high speeds, a violent kick back through the jack to the overlying intermediate jack, the latter being thrown violently against the overlying guide cam of the intermediate jacks, thus breaking its butt. According to this invention, the jack is instead guided gradually, to reach a path line very close to the horizontal before its lower or base face contacts the ring base surface, and remaining for a short while at few tenths of a millimeter from that surface, and approaching it progressively after its descent kinetic energy, due to the vertical component of speed, is virtually nil, as virtually nil is that component. Hence, the lower face of the jack contacts the base surface tenderly, thereby no kick back can be transmitted to the overlying intermediate jack. Actual tests have proved that this explanation of the phenomenon is correct, and no butt breakages were any more experienced, not even at speeds of 600 RPM and above.

BRIEF DESCRIPTION OF THE DRAWINGS

Further details of this invention will become apparent from the following description of a preferred, but not exclusive, embodiment thereof, being illustrated by way of example only in the accompanying drawing, where.

DESCRIPTION OF THE PREFERRED EMBODIMENTS

Figure 2:
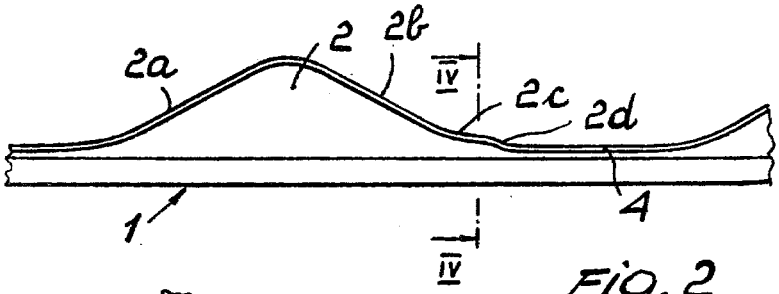
FIG. 2 is a developed representation, as viewed from the outside, of a jack control cam according to this invention.

With reference to the cited drawing figures, the numeral 1 denotes the jack guiding ring which carries the raising and lowering cams 2 for the pattern jacks 3 of a single cylinder machine equipped with jacks of the tilting type. It has been assumed that the machine has four yarn feeds, hence the provision for four cams 2, one at each feed. However, it will be apparent that there may be provided any number of such cams. The cams 2 are separated by horizontally extending portions 4, and have each a substantially triangular profile comprising an upward sloping portion 2*a* and downward sloping portion 2*b*. The guide ring 1 for the jacks 3 is affixed to the machine own structure in a manner known per se.

At 5 is indicated the annular control cam guiding the intermediate jacks 6, this cam having a bottom profile provided, in a manner known per se, with notches or recesses 7 at the machine yarn feeds. The recesses 7 are arranged just above the cams 2. As is known in the art, the downwardly directed edges of the recesses 7 cause, on acting on the butts 6*a*, of the intermediate jacks 6, downward movement of the intermediate jacks 6 and of the pattern jacks 3 arranged thereunder. The cam 5 is also affixed to the machine stationary structure in a conventional manner.

The numeral 8 denotes that part of the cam box which is associated with the needles 9, such part being only shown in its most essential elements.

Figure 4:
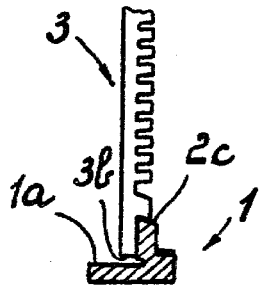
FIG. 4 is a sectional view taken along the line IV—IV of FIG. 2 on an enlarged scale.
Figure 3:
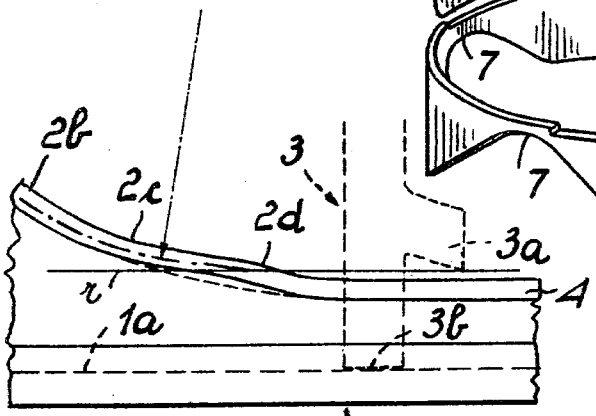
FIG. 3 is an enlarged scale view of the terminating or end portion of the downward sloping portion of the cam according to this invention.
Figure 1:
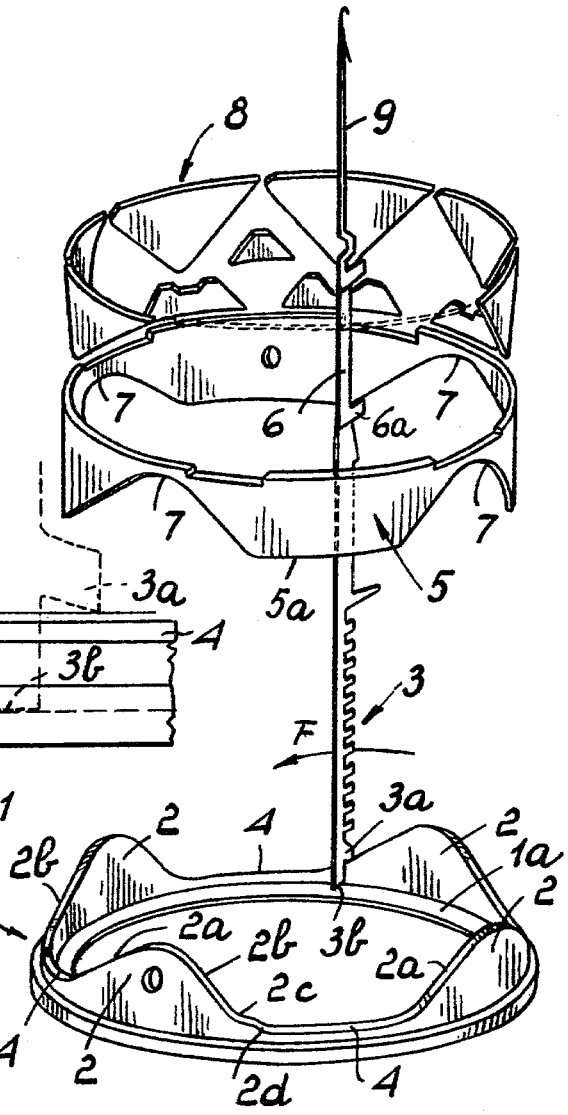
FIG. 1 is a perspective view of part of the cam box of a machine incorporating the device according to this invention, the illustration including a pattern jack, its respective intermediate jack, and a needle.

According to the invention, the downward sloping portion 2*b* of the cams 2 includes, at the terminating or end portion thereof, a curvilinear portion 2*c* connected at the downward sloping portion 2*b* and having a smaller radius than the ideal one as would result from a direct connection of the portion 2*b* to the horizontally extending portion 4. In FIG. 3, such an ideal connection, which is the one employed in conventional machines, is shown in dotted lines, whilst a dash-and-dot line represents the connection according to this invention, and specifically the path followed by the lower outer tip of the lower butt 3*a* of the jacks 3. This drawing figure shows, for clarity, the jack 3 as turned over 90° with respect to its actual position, whereas FIG. 4 shows its actual position as the jack approaches the lowermost point of the curvilinear portion 2*c*.

It will be noted that the portion 2*c* tends to reach, with respect to the base surface 1*a*, a height level which is substantially equal to the level of the lower or bottom face of the butt 3*a* with respect to the base face 3*b* of the jack 3, and joins the horizontally extending further downward sloping portion 4 by means of a portion 2*d*, preferably having a slope gradient smaller than the gradient of the downward sloping portion 2*b* of the cam 2.

In this manner, a curve is defined which has two points of inflexion, or in other terms, a sort of rounded step at the terminating or end portion of the cam 2, which having the features indicated, affords prevention of sharp impacts of the or bottom face 3*b* of the jack 3 against the base surface 1*a* as the jack descends the cam 2. In fact, as may be observed from the dotted line of FIG. 3, wherealong moves the lowermost outer corner of the butt 3*a* (while the inclined lower face of the butt concurrently engages the cam portion included between the dotted line and uppermost corner of the cam 2 located on the inside of the ring 1), at the point of intersection of the dotted line with the horizontal straight line r indicating the path followed by the lower tip of the butt 3*a* after the lower face 3*b* of the jack has contacted the base surface 1*a*, the vertical component of the movement of the jack 3 is irrelevant. Not so in the prior art machines, where that component is substantially larger, as may be observed by extending ideally the top portion of the dash-and-dot line of FIG. 3 with a radius equal to the radius of the dotted ideal connection, and by comparing the angle formed by that extension with the horizontal straight line r at the point of intersection therewith. In this case, the jack 3 experiences a sharp transition from a movement having a clearly defined vertical component to a movement having no vertical component, thus receiving a kick back which is transmitted to the overlying intermediate jack, the butt 6*a*, whereof, upon striking violently the bottom profile of the cam 5, breaks. By contrast, in the invention design, the jack 3 goes over from a movement having a practically insignificant vertical component to a movement the vertical component whereof is nil, thereby, and even at high speeds, it is no longer subjected to any appreciable impact, nor is any kick back transmitted to the intermediate jack 6, the butt 6*a* whereof remains intact.

As visible in FIG. 3, the level of the horizontal portion 4 with respect to the base surface 1*a* is lower than the level of the bottom face of the lower butts with respect to the base face 3*b* of the jacks 3, so as to allow tilting of the jacks 3 radially for purposes of pattern selection, as is well known in the art. Accidental tilting of the jacks 3 is however prevented from occurring because of frictional engagement of the jacks in the tricks of the needle cylinder, said frictional engagement being provided, as is well known in the art, by being the jacks slightly inflected instead of being exactly flat.

Clearly, the portion 2*d* sloping further downwards may be arranged at a position downstream, in the direction F of movement of the jacks, of the position shown, since its only function is that of smoothly connecting the portion 2*c* to the horizontally extending portion 4. In this case the portion 2*d* would start at a point arranged after the pattern jacks 3 contact the base surface 1*a*. However, when arranging the portion 2*d* in such a downstream position, consideration will be given to the circumferential space available for the radial tilting movement of the jacks before and after the needle selection operation. Alternatively, the portion 2*d* could also be arranged upstream with respect to the position shown, so that the portion 2*d* would start slightly before the pattern jacks 3 contact the base surface 1*a*, thus slightly increasing the gap between the vertical component before and after the jacks 3 contact the base surface 1*a*, which approach could have no influence, within a certain range of machine operating speeds, owing to the transition from the portion 2*c* to the portion 2*d* being initially very slow.

As may be noted, the device according to this invention, in addition to being of reliable effectiveness as the extensive testing carried out confirms, is also of very simple construction.

The invention described hereinabove is susceptible to many modifications and variations thereof within the scope of the appended claims. For example, the cam 5, which is known to have a horizontal portion 5*a* at a level such as to leave a certain clearance between the intermediate jacks 6 and respective jacks 3 as the latter move along the portion 4, could have a bottom profile substantially matching the profile of the cam 2, were the clearance insufficient at the portion where the notch or recess 7 ends and the horizontal portion 5*a* begins. The portion 2*d* of the cam 2 could have, at the portion not in engagement with the lower butt of the jacks, a high gradient slope, e.g. equal to that of the portion 2*b* of the cam 2. Obviously, nothing would change if the intermediate jack and pattern jack, rather than being two discrete members, are an integral construction, i.e. if the butt 6*a* is formed directly on the jack 3, and this extends for at least part of the height of the intermediate jack 6.

I claim:

1. A safety device in a circular knitting machine, in particular a high speed single cylinder stocking knitting machine of the type having tiltable pattern jacks, intermediate jacks thereover, needles arranged over said intermediate jacks, and a pattern jack guiding ring, said pattern jacks each having a base face and a lower butt having a bottom face, and said pattern jack guiding ring comprising:

(a) at least one cam having a substantially triangular profile having an upward and a downward sloping portion for lifting and lowering said pattern jacks by engagement with said lower butts, (b) at least one horizontally extending portion downstream of said at least one cam adapted to permit said pattern jacks to tilt in and out, and (c) a continuous base surface inside said guiding ring for engaging said base face of said pattern jacks when said lower butts are not being engaged by said at least one cam, wherein said at least one cam further comprises, at the end of said downward sloping portion, (i) a curvilinear portion joining said downward sloping portion and having a smaller radius of curvature than an ideal radius of connection of said downward sloping portion to said at least one horizontally extending portion, said curvilinear portion tending to reach, with respect to said base surface, a level substantially corresponding to the level of said bottom face of said lower butts of said pattern jacks with respect to said base face of said pattern jacks, and (ii) a further downward sloping portion between said curvilinear portion and said at least one horizontally extending portion.

2. A device according to claim 1, wherein said further downward sloping portion starts at a point arranged shortly before said pattern jacks contact said base surface.

3. A device according to claim 1, wherein said further downward sloping portion starts at a point arranged after said pattern jacks contact said base surface.

4. A device according to claim 1, wherein said further downward sloping portion has a slope gradient smaller than the gradient of said downward sloping portion of said at least one cam.

5. A device according to claim 1, further comprising a control cam for said intermediate jacks, said control cam having a bottom profile substantially matching said profile of said at least one cam.

* * * * *